US010088765B2

(12) United States Patent
Miyakai et al.

(10) Patent No.: US 10,088,765 B2
(45) Date of Patent: Oct. 2, 2018

(54) TONER AND METHOD FOR PRODUCING TONER

(71) Applicant: CANON KABUSHIKI KAISHA, Tokyo (JP)

(72) Inventors: Tomoyo Miyakai, Kashiwa (JP); Hayato Ida, Toride (JP); Takaho Shibata, Tokyo (JP); Junichi Tamura, Toride (JP); Ryuji Murayama, Nagareyama (JP); Daisuke Yamashita, Tokyo (JP); Takashi Hirasa, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/730,337

(22) Filed: Oct. 11, 2017

(65) Prior Publication Data

US 2018/0107128 A1 Apr. 19, 2018

(30) Foreign Application Priority Data

Oct. 17, 2016 (JP) ..... 2016-203712
Sep. 8, 2017 (JP) ..... 2017-173392

(51) Int. Cl.
*G03G 9/087* (2006.01)
*G03G 9/08* (2006.01)

(52) U.S. Cl.
CPC ..... *G03G 9/08704* (2013.01); *G03G 9/0804* (2013.01); *G03G 9/08722* (2013.01); *G03G 9/08724* (2013.01); *G03G 9/08726* (2013.01); *G03G 9/08728* (2013.01); *G03G 9/08733* (2013.01); *G03G 9/08795* (2013.01)

(58) Field of Classification Search
CPC ..... G03G 9/087; G03G 9/08704; G03G 9/08724; G03G 9/08722
See application file for complete search history.

(56) References Cited

U.S. PATENT DOCUMENTS

| | | | |
|---|---|---|---|
| 3,853,778 | A | 12/1974 | Buckley et al. |
| 5,154,998 | A | 10/1992 | Aoki et al. |
| 7,833,687 | B2 | 11/2010 | Kato et al. |
| 8,697,327 | B2 | 4/2014 | Shibata et al. |
| 9,057,970 | B2 | 6/2015 | Ida et al. |
| 9,348,247 | B2 | 5/2016 | Ida et al. |
| 9,540,483 | B2 | 1/2017 | Ida et al. |
| 9,696,644 | B2 | 7/2017 | Ida et al. |
| 2013/0108955 | A1 | 5/2013 | Shibata et al. |
| 2013/0202998 | A1 | 8/2013 | Higashi et al. |
| 2015/0099227 | A1 | 4/2015 | Ida et al. |

FOREIGN PATENT DOCUMENTS

| | | | |
|---|---|---|---|
| DE | 2542374 | | 4/1976 |
| EP | 0427614 | | 5/1991 |
| JP | S56-013943 | B2 | 4/1981 |
| JP | S58-095750 | A | 6/1983 |
| JP | S59-018954 | A | 1/1984 |
| JP | S62-039428 | B2 | 8/1987 |
| JP | H03-150576 | A | 6/1991 |
| JP | H04-021860 | A | 1/1992 |
| JP | H04-120554 | A | 4/1992 |
| JP | H08-184986 | A | 7/1996 |
| JP | H11-202555 | A | 7/1999 |
| JP | 2011-107261 | A | 6/2011 |

OTHER PUBLICATIONS

U.S. Appl. No. 15/527,191, Takaho Shibata, filed May 16, 2017.
U.S. Appl. No. 15/532,543, Junichi Tamura, filed Jun. 2, 2017.
U.S. Appl. No. 15/687,726, Daisuke Yamashita, filed Aug. 28, 2017.
U.S. Appl. No. 15/693,662, Hayato Ida, filed Sep. 1, 2017.

*Primary Examiner* — Hoa V Le
(74) *Attorney, Agent, or Firm* — Fitzpatrick Cella Harper and Scinto

(57) ABSTRACT

A toner comprising a toner particle including a resin component, wherein the resin component includes an olefin resin and an olefin copolymer including a hydroxyl group, the olefin resin has a specific monomer unit Y1, the olefin copolymer including a hydroxyl group has a specific monomer unit Z1 and Z2, a hydroxyl value of the olefin resin is not more than 10 mg KOH/g, a hydroxyl value of the olefin copolymer including a hydroxyl group is at least 20 mg KOH/g and not more than 250 mg KOH/g, and a content of the olefin resin in the resin component is more than 50 mass % with respect to a total mass of the resin component.

15 Claims, No Drawings

TONER AND METHOD FOR PRODUCING TONER

BACKGROUND OF THE INVENTION

Field of the Invention

The present invention relates to a toner for use in an electrophotographic system and a method for producing the same.

Description of the Related Art

Following recent increase in demand for energy saving in image formation, efforts have been taken to lower the fixing temperature of toners. Japanese Examined Patent Publication Nos. S56-13943 and S62-39428 and Japanese Patent Application Publication No. H04-120554 have suggested a technique using a crystalline polyester resin having a sharp melt property, such that the viscosity is significantly reduced when a melting point is exceeded, as one of methods for improving low-temperature fixability of toners.

Further, Japanese Patent Application Publication Nos. 2011-107261, H11-202555, H08-184986, H04-21860, H3-150576, S59-18954, and S58-95750 have suggested, as another method, to lower the fixing temperature by using a resin having a low glass transition temperature, such as polyethylene. A toner including a copolymer including an ethylene ester group such as ethylene-vinyl acetate copolymer or ethylene-methyl acrylate copolymer as a resin having a low glass transition temperature has been suggested.

SUMMARY OF THE INVENTION

When a conventional crystalline polyester resin is used as a resin for an electrophotographic toner, the resin shows excellent low-temperature fixability due to sharp melting property thereof. However, crystalline polyester resins have low electric resistance, and a problem is associated with charge retention property of toners using such resins.

Accordingly, the inventors of the present invention focused attention on a copolymer having an olefin unit such as ethylene or propylene as a resin having a high volume resistance and a glass transition temperature of room temperature or lower. Specifically, an attempt was made to improve the low-temperature fixability by using an ethylene (propylene)-acetic acid ester copolymer such as ethylene-vinyl acetate copolymer, an ethylene (propylene)-acrylic acid ester copolymer such as ethylene-methyl acrylate copolymer, an ethylene (propylene)-methacrylic acid ester copolymer such as ethylene-methyl methacrylate copolymer, and the like. However, it is difficult to satisfy the low-temperature fixability under high-speed conditions merely by including a part of such olefin resins in the toners suggested in Japanese Patent Application Publication Nos. 2011-107261, H11-202555, H08-184986, H04-21860 and H03-150576.

Meanwhile, when such olefin resins are used as a main resin of the toner, as disclosed in Japanese Patent Application Publication Nos. S59-18954 and S58-95750, a problem is associated with low adhesion between the toner and paper. In particular, the decrease in adhesion between the toner and paper is particularly remarkable and disadvantageous when using an electrophotographic recording method of a thermal fixing system in which a low pressure is applied to the toner at the time of fixing. The resultant problem is that the toner is peeled off from the paper when the fixed matter after thermal fixing is rubbed with an eraser or the like.

An object of the present invention is to provide a toner excellent in low-temperature fixability, adhesion to paper, and charge retention property.

As a result of comprehensive research conducted by the inventors of the present invention, it has been found that a toner excellent in low-temperature fixability, adhesion to paper, and charge retention property can be obtained by using olefin resins of, for instance, an ethylene (propylene)-acetic acid ester copolymer such as ethylene-vinyl acetate copolymer, an ethylene (propylene)-acrylic acid ester copolymer such as ethylene-methyl acrylate copolymer, an ethylene (propylene)-methacrylic acid ester copolymer such as ethylene-methyl methacrylate copolymer, and a mixture thereof as a main resin, and further using an olefin copolymer including a hydroxyl group in combination therewith.

It is conceivable that these olefin resins and the olefin copolymers including a hydroxyl group have high compatibility due to similarity in chemical structure thereof and are, therefore, present without causing complete phase separation in the toner. Furthermore, the hydroxyl groups of the olefin copolymers including a hydroxyl group form hydrogen bonds with the hydroxyl groups on the paper surface at the time of fixing. It is apparently for these two reasons that the toner exhibits high adhesion to paper.

Thus, the toner of the present invention is a toner comprising a toner particle including a resin component, wherein the resin component includes an olefin resin and an olefin copolymer including a hydroxyl group;

the olefin resin has a monomer unit Y1 represented by a following formula (1);

the olefin copolymer including a hydroxyl group has a monomer unit Z1 represented by a following formula (2) and a monomer unit Z2 represented by a following formula (3);

a hydroxyl value of the olefin resin is not more than 10 mg KOH/g;

a hydroxyl value of the olefin copolymer including a hydroxyl group is at least 20 mg KOH/g and not more than 250 mg KOH/g; and a content of the olefin resin in the resin component is more than 50 mass % with respect to a total mass of the resin component.

(1)

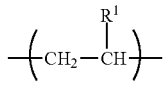

(2)

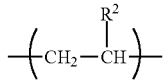

(3)

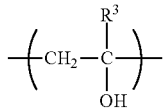

(In the formulas, $R^1$ represents H or $CH_3$, $R^2$ represents H or $CH_3$, and $R^3$ represents H or $CH_3$.)

The present invention also provides a method for producing a toner including a toner particle including a resin component, the resin component including an olefin resin and an olefin copolymer including a hydroxyl group, the method comprising a preparation step of preparing a resin fine particle dispersion in which resin fine particles for producing the resin component are dispersed in an aqueous medium, wherein the olefin resin has a monomer unit Y1 represented by formula (1);

the olefin copolymer including a hydroxyl group has a monomer unit Z1 represented by formula (2) and a monomer unit Z2 represented by formula (3);

a hydroxyl value of the olefin resin is not more than 10 mg KOH/g;

a hydroxyl value of the olefin copolymer including a hydroxyl group is at least 20 mg KOH/g and not more than 250 mg KOH/g; and a content of the olefin resin in the resin component is more than 50 mass % with respect to a total mass of the resin component.

According to the present invention, it is possible to provide a toner excellent in low-temperature fixability, adhesion to paper, and charge retention property.

Further features of the present invention will become apparent from the following description of exemplary examples.

DESCRIPTION OF THE EMBODIMENTS

In the present invention, the expression "at least AA and not more than BB" or "AA to BB" representing the numerical range means a numerical range including the lower limit and the upper limit which are endpoints, unless specifically stated otherwise.

Further, the monomer unit refers to a reacted form of a monomer substance in a polymer or a resin.

Further, the crystalline resin is a resin in which an endothermic peak is observed in differential scanning calorimetry (DSC).

In the present invention, the resin component means a polymer component mainly contributing to fixing performance. The resin component includes an olefin resin and an olefin copolymer including a hydroxyl group. A single olefin resin or a plurality of olefin resins may be included in the resin component.

The olefin resin is a polymer having a polyolefin skeleton and has a monomer unit Y1 represented by the following formula (1).

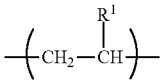

(1)

(In the formula, $R^1$ is H or $CH_3$.)

Specific examples of the olefin resin include polyolefins such as polyethylene and polypropylene, ethylene (propylene)-acetic acid ester copolymers such as ethylene-vinyl acetate copolymer, ethylene (propylene)-acrylic acid ester copolymers such as ethylene-methyl acrylate copolymer, and ethylene (propylene)-methacrylic acid ester copolymers such as ethylene-methyl methacrylate copolymer.

The hydroxyl value of the olefin resin is not more than 10 mg KOH/g, and preferably not more than 1 mg KOH/g. From the viewpoint of charge retention property, it is preferable that the hydroxyl value of the olefin resin be substantially 0 mg KOH/g.

The hydroxyl value is the number of milligrams of potassium hydroxide required to neutralize acetic acid bonded to hydroxyl groups when 1 g of a sample is acetylated. The hydroxyl value can be measured by a measuring method according to JIS-K0070.

A method for measuring the hydroxyl value is described below.

The hydroxyl value is the number of milligrams of potassium hydroxide required to neutralize acetic acid bonded to hydroxyl groups when 1 g of a sample is acetylated.

(1) Preparation of Reagent

A total of 25 g of special grade acetic anhydride is placed into a 100 mL volumetric flask, pyridine is added to make the total volume 100 mL, and the components are sufficiently shaken to obtain an acetylation reagent. The obtained acetylation reagent is stored in a brown bottle to prevent contact with moisture, carbon dioxide, and the like.

A total of 1.0 g of phenolphthalein is dissolved in 90 mL of ethyl alcohol (95 vol %), and ion-exchanged water is added to make 100 mL and obtain a phenolphthalein solution.

A total of 35 g of special grade potassium hydroxide is dissolved in 20 mL of water and ethyl alcohol (95 vol %) is added to make 1 L. The solution is poured in an alkali-resistant container and allowed to stand for 3 days so as to prevent contact with carbon dioxide and the like and then filtered to obtain a potassium hydroxide solution. The obtained potassium hydroxide solution is stored in an alkali-resistant container. A total of 25 mL of 0.5 mol/L hydrochloric acid is taken into an Erlenmeyer flask, a few drops of the phenolphthalein solution are added, titration is performed with the potassium hydroxide solution, and the factor of the potassium hydroxide solution is determined from the amount of the potassium hydroxide solution required for neutralization. The 0.5 mol/L hydrochloric acid is prepared according to JIS K 8001-1998.

(2) Operation (A) Main Test

A total of 1.0 g of the crushed sample is accurately weighed in a 200 mL round bottom flask, and 5.0 mL of the acetylation reagent is precisely added thereto using a whole pipette. In this case, when the sample is difficult to dissolve in the acetylation reagent, a small amount of special grade toluene is added to facilitate the dissolution.

A small funnel is placed in the mouth of the flask and about 1 cm of the bottom portion of the flask is immersed and heated in a glycerin bath at about 97° C. At this time, in order to prevent the heat of the bath from raising the temperature of the neck of the flask, it is preferable to cover the neck of the flask with cardboard having a round hole.

After 1 h, the flask is removed from the glycerin bath and allowed to cool. After cooling down, 1 mL of water is added from the funnel and shaken to hydrolyze acetic anhydride. For even more complete hydrolysis, the flask is again heated in the glycerin bath for 10 min. After cooling, the walls of the funnel and flask are washed with 5 mL of ethyl alcohol.

A few drops of the phenolphthalein solution are added as an indicator and titration is performed with a potassium hydroxide solution. The end point of the titration is when the light crimson color of the indicator lasts about 30 sec.

(B) Blank Test

The titration is performed in the same manner as in the abovementioned operation except that no sample is used.

(3) The Obtained Result is Substituted into the Following Equation to Calculate the Hydroxyl Value.

$$A=[\{(B-C)\times 28.05\times f\}/S]+D$$

Here, A: hydroxyl value (mg KOH/g), B: amount (mL) added of the potassium hydroxide solution in the blank test, C: amount (mL) added of the potassium hydroxide solution in the main test, f: factor of the potassium hydroxide solution, S: sample (g), and D: acid value (mg KOH/g) of the sample.

The content of the olefin resin is more than 50 mass %, preferably not less than 70 mass %, based on the total mass of the resin component. This range is preferable from the viewpoint of low-temperature fixing. Since the glass transition temperature of the olefin resin is not more than 0° C., satisfactory low-temperature fixability is obtained by including the olefin resin in the resin component in an amount of more than 50 mass %.

From the viewpoint of charging performance, low-temperature fixability, and blocking resistance, it is preferable that the olefin resin be an olefin copolymer including an ester group in which an ester group unit is introduced into the polyolefin skeleton at a ratio of at least 3 mass % and not more than 35 mass % by copolymerization or the like. It is preferable that the olefin copolymer including an ester group has at least one monomer unit Y2 selected from the group consisting of a monomer unit represented by the following formula (4) and a monomer unit represented by the following formula (5) in addition to the monomer unit Y1 represented by the following formula (1).

(1)

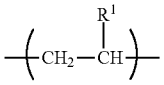

(4)

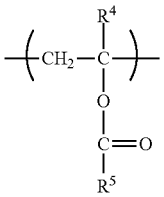

(5)

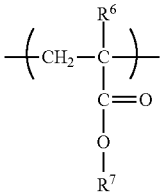

(In the formulas, $R^1$ is H or $CH_3$, $R^4$ is H or $CH_3$, $R^5$ is $CH_3$ or $CH_2CH_3$, $R^6$ is H or $CH_3$, and $R^7$ is $CH_3$ or $CH_2CH_3$.)

The at least one monomer unit Y2 selected from the group consisting of a monomer unit represented by the following formula (4) and a monomer unit represented by the following formula (5) will be described hereinbelow in detail.

It is preferable that the olefin resin be an ethylene-vinyl acetate copolymer having a monomer unit represented by formula (1) and a monomer unit represented by formula (4), in which $R^1$ is H, $R^4$ is H, and $R^5$ is $CH_3$. As a result, a low melting point can be designed, and therefore the low-temperature fixability is improved.

It is also preferable that the olefin resin be:

an ethylene-methyl acrylate copolymer having a monomer unit represented by formula (1) and a monomer unit represented by formula (5) in which $R^1$ is H, $R^6$ is H, and $R^7$ is $CH_3$, an ethylene-ethyl acrylate copolymer having a monomer unit represented by formula (1) and a monomer unit represented by formula (5), in which $R^1$ is H, $R^6$ is H, and $R^7$ is $C_2H_5$, or an ethylene-methyl methacrylate copolymer having a monomer unit represented by formula (1) and a monomer unit represented by formula (5) in which $R^1$ is H, $R^6$ is $CH_3$, and $R^7$ is $CH_3$. Because of high chemical stability, storage performance under high temperature and high humidity is improved.

The total mass of the olefin resin is denoted by W, and the mass of the monomer units represented by formulas (1), (4) and (5) is denoted by l, m, and n, respectively. From the viewpoints of low-temperature fixability and charge retention property, it is preferable that the value of (l+m+n)/W of the olefin resin included in the resin component be at least 0.80, more preferably at least 0.95, and even more preferably 1.00.

From the viewpoints of charge retention property, low-temperature fixability, and blocking resistance, it is preferable that the content of the monomer unit Y2 be at least 3 mass % and not more than 35 mass %, and more preferably at least 5 mass % and not more than 20 mass %, based on the total mass of the olefin resin. Where the ratio of the monomer unit Y2 is not more than 35 mass %, the charge retention property and blocking resistance of the toner are improved. Meanwhile, where the average ratio of the monomer units Y2 of the olefin resin is at least 3 mass %, the adhesion to paper is improved and the low-temperature fixability is improved.

The masses l, m, and n of the monomer units and the ratio of the monomer unit Y2 can be measured by general analytical methods and examples thereof include nuclear magnetic resonance (NMR) and pyrolysis gas chromatography.

The measurement method using $^1$H-NMR is described below. The content ratios of the respective monomer units can be calculated by comparing integral ratios of hydrogen atoms of the alkylene groups shown in the monomer units (1), hydrogen atoms of the acetyl groups shown in the monomer units (4), and hydrogen atoms of the methyl groups or ethylene groups bonded to the oxygen in the monomer units (5).

Specifically, the content ratio of the monomer units in the ethylene-vinyl acetate copolymer is calculated in the following manner. About 5 mg of the sample is dissolved in 0.5 mL of heavy acetone including tetramethylsilane as an internal standard at 0.00 ppm, the solution is placed in a sample tube, and $^1$H-NMR measurement is performed under the conditions of a repetition time of 2.7 sec and an integration frequency of 16 times. Since the peak at 1.14 ppm to 1.36 ppm corresponds to $CH_2$—$CH_2$ of the ethylene monomer unit and the peak close to 2.04 ppm corresponds to $CH_3$ of the vinyl acetate unit, the ratio of the integral values of these peaks is calculated and then the content ratio is calculated.

The olefin resin may have a monomer unit other than the monomer unit Y1 and the monomer unit Y2. Such a monomer unit is not particularly limited as long as the effect of the present invention is not impaired, and the examples thereof include a monomer unit represented by formula (6) and a monomer unit represented by formula (7). These monomer units can be introduced by adding the respective monomers during a copolymerization reaction for producing the olefin resin or by modifying the olefin resin by a polymer reaction.

(6)

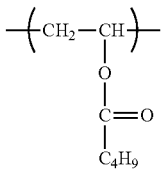

-continued (7)

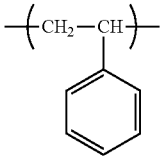

However, from the viewpoint of charge retention property, the acid value of the olefin resin is preferably not more than 10 mg KOH/g, more preferably not more than 5 mg KOH/g, and still more preferably substantially 0 mg KOH/g.

The acid value is the number of milligrams of potassium hydroxide required to neutralize the acid component such as a free fatty acid and a resin acid contained in 1 g of the sample. The measurement is performed according to JIS-K0070 in the following manner.

(1) Reagent

A total of 1.0 g of phenolphthalein is dissolved in 90 mL of ethyl alcohol (95 vol %), and ion exchanged water is added to make 100 mL and obtain a phenolphthalein solution.

A total of 7 g of special grade potassium hydroxide is dissolved in 5 mL of water, and ethyl alcohol (95 vol %) is added to make 1 L. The solution is poured in an alkali-resistant container and allowed to stand for 3 days so as to prevent contact with carbon dioxide and the like and then filtered to obtain a potassium hydroxide solution. The obtained potassium hydroxide solution is stored in an alkali-resistant container. A total of 25 mL of 0.1 mol/L hydrochloric acid is taken into an Erlenmeyer flask, a few drops of the phenolphthalein solution are added, titration is performed with the potassium hydroxide solution, and the factor of the potassium hydroxide solution is determined from the amount of the potassium hydroxide solution required for neutralization. The 0.1 mol/L hydrochloric acid is prepared according to JIS K 8001-1998.

(2) Operation (A) Main Test

A total of 2.0 g of the crushed sample is accurately weighed in a 200 mL Erlenmeyer flask, and 100 mL of a mixed solution of toluene/ethanol (2:1) is added and dissolved over 5 h. Next, a few drops of the phenolphthalein solution are added as an indicator, and titration is carried out using the potassium hydroxide solution. The end point of the titration is when the light crimson color of the indicator lasted about 30 sec.

(B) Blank Test

The titration is performed in the same manner as in the abovementioned operation except that no sample is used (that is, only a mixed solution of toluene/ethanol (2:1) is used).

(3) The Obtained Result is Substituted into the Following Equation to Calculate the Acid Value.

$$A=[(C-B)\times f\times 5.61]/S$$

Here, A: acid value (mg KOH/g), B: amount (mL) added of potassium hydroxide solution in the blank test, C: amount (mL) added of the potassium hydroxide solution in the main test, f: factor of the potassium hydroxide solution, and S: sample (g).

The softening point (Tm) of the olefin resin is preferably at least 120° C. and not more than 160° C. When the Tm is at least 120° C., the strength of the toner is improved and blocking is unlikely to occur at the time of storage. In addition, from the viewpoint of image glossiness, it is preferable that the Tm of the olefin resin be not more than 160° C.

The softening point (Tm) can be measured using a capillary rheometer of a load extrusion system "Flow Characteristic Evaluation Device, Flow Tester CFT-500D" (manufactured by Shimadzu Corporation).

In the CFT-500D, the measurement sample charged in a cylinder is melted while elevating the temperature and applying a constant load from the top with a piston, and the sample is extruded from a capillary hole at the bottom of the cylinder. The flow curve is plotted from the descent amount (mm) of the piston and the temperature (° C.) at this time.

In the present invention, the "melting temperature in a ½ method" described in the manual attached to the "Flow Characteristic Evaluation Device, Flow Tester CFT-500D" is taken as the softening point.

The melting temperature in a ½ method is calculated in the following manner.

First, ½ of the difference between the descent amount of the piston at the end of the outflow (taken as an outflow end point, Smax) and the descent amount of the piston at the start of the outflow (taken as a minimum point, Smin) is obtained (this difference is denoted by X; X=(Smax−Smin)/2). The temperature of the flow curve when the descent amount of the piston becomes the sum of X and Smin is taken as the melting temperature in a ½ method.

The measurement sample is prepared by compression molding of 1.2 g of a sample under an environment of 25° C. for 60 sec at 10 MPa by using a tablet molding compressor (for example, Standard Manual Newton Press NT-100H, manufactured by NPA System Co., Ltd.), and has a columnar shape with a diameter of 8 mm.

Specific operations in the measurement are performed according to the manual attached to the device.

Measurement conditions of CFT-500D are presented hereinbelow.

Test mode: temperature rising method
Starting temperature: 60° C.
Temperature reached: 200° C.
Measurement interval: 1.0° C.
Heating rate: 4.0° C./min
Piston cross section area: 1.000 $cm^2$
Test load (piston load): 5.0 kgf
Preheating time: 300 sec
Die hole diameter: 1.0 mm
Die length: 1.0 mm The Tm can be controlled by changing the molecular weight of the olefin resin (preferably the olefin copolymer including an ester group), and the Tm can be increased by increasing the molecular weight. Specifically, the molecular weight of the olefin resin is preferably a weight average molecular weight of at least 50,000, and more preferably at least 100,000. Further, from the viewpoint of image glossiness, the molecular weight of the olefin resin is preferably not more than 500,000.

The elongation at break of the olefin resin is preferably at least 300%, and more preferably at least 500%. When the elongation at break becomes 300% or more, the bending resistance of the fixed material becomes satisfactory.

The elongation at break is measured under the conditions based on JIS K 7162. When a plurality of olefin copolymers including an ester group is contained in the binder resin, measurement is carried out under the abovementioned conditions after melt mixing.

The olefin copolymer including a hydroxyl group is a polymer in which a hydroxyl group unit is introduced into the polyolefin skeleton by copolymerization or the like, and specifically includes a monomer unit Z1 represented by the following formula (2) and a monomer unit Z2 represented by the following formula (3).

(2)

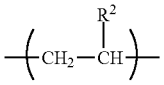

(3)

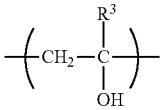

(In the formulas, $R^2$ is H or $CH_3$ and $R^3$ is H or $CH_3$.)

The monomer unit represented by formula (2) and the monomer unit represented by formula (3) will be described hereinbelow in detail.

From the viewpoint of low-temperature fixability, it is preferable that the olefin copolymer including a hydroxyl group be a copolymer (also referred to as ethylene-Poval copolymer) in which $R^2$ is H and $R^3$ is H in the formulas of the monomer unit represented by formula (2) and the monomer unit represented by formula (3), because such a copolymer can be designed with a low melting point.

The resin component may include one or a plurality of olefin copolymers each including a hydroxyl group.

The olefin copolymer including a hydroxyl group has a hydroxyl value of at least 20 mg KOH/g and not more than 250 mg KOH/g. From the viewpoint of adhesion to paper, it is preferable that the hydroxyl value be at least 80 mg KOH/g, and from the viewpoint of charge retention property, it is preferable that the hydroxyl value be not more than 200 mg KOH/g. The hydroxyl value of the olefin copolymer including a hydroxyl group can be measured by the same method as used for measuring the hydroxyl value of the olefin resin.

The total mass of the olefin copolymer including a hydroxyl group is denoted by M, and the mass of the monomer unit represented by formulas (2) and (3) is a and b, respectively. From the viewpoints of low-temperature fixability and charge retention property, it is preferable that the value of (a+b)/M of the olefin copolymer including a hydroxyl group and contained in the resin component be at least 0.80, more preferably at least 0.95, and even more preferably 1.00.

The olefin copolymer including a hydroxyl group may include a monomer unit other than the monomer unit Z1 and the monomer unit Z2. Such a monomer unit is not particularly limited as long as the effect of the present invention is not impaired, and the examples thereof include a monomer unit represented by formula (6), a monomer unit represented by formula (7), and a monomer unit represented by formula (8) below. These monomer units can be introduced by adding the respective monomer during a copolymerization reaction for producing the olefin copolymer including a hydroxyl group or by modifying the olefin copolymer including a hydroxyl group by a polymer reaction.

(6)

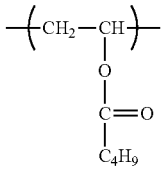

(7)

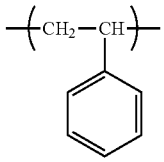

(8)

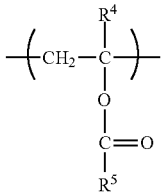

(In the formulas, $R^4$ represents H or $CH_3$, $R^5$ represents $CH_3$ or $C_2H_5$.)

From the viewpoints of low-temperature fixability, charge retention property and adhesion to paper, it is preferable that the content of the olefin copolymer including a hydroxyl group be at least 10 mass % and less than 50 mass % with respect to the total mass of the resin component. This content is more preferably at least 10 mass % and not more than 30 mass %.

From the viewpoint of improving the low-temperature fixability and charge retention property, it is preferable that the content of the monomer unit Z2 in the olefin copolymer including a hydroxyl group be at least 2 mass % and not more than 20 mass %, and more preferably at least 2 mass % and not more than 10 mass %, based on the total mass of the olefin copolymer including a hydroxyl group. When the content is not more than 20 mass %, the melting point is lowered and the low-temperature fixability and charge retention property of the toner are improved. Meanwhile, when the content is at least 2 mass %, hot offset resistance is improved due to interaction between intermolecular hydrogen bonds generated by hydroxyl groups.

The masses a and b of the monomer units and the ratio of the monomer unit Z2 can be measured by general analytical methods, and examples thereof include nuclear magnetic resonance ($^1$H-NMR) and pyrolysis gas chromatography. Measurement of the olefin copolymer including a hydroxyl group by $^1$H-NMR can be carried out by the same method as the abovementioned measurement of the olefin resin by $^1$H-NMR.

An example of measurement using $^1$H-NMR is described below. The content ratios of the respective monomer units can be calculated by comparing integral ratios of hydrogen atoms of the alkylene groups of the monomer units represented by formula (2) and hydrogen atoms of the methine groups bonded to the hydroxyl groups in the monomer units represented by formula (3).

Specifically, the content ratio of the monomer units of the ethylene-Poval copolymer is calculated in the following manner.

About 5 mg of the sample is dissolved in 0.5 mL of heavy dimethyl sulfoxide (DMSO) including tetramethylsilane as an internal standard at 0.00 ppm and tetrafluoroacetic acid (TFA) as an additive.

The solution is placed in a sample tube, and $^1$H-NMR measurement is performed under the conditions of a repetition time of 2.7 sec and an integration frequency of 16 times. Since the peak at 1.1 ppm to 1.4 ppm corresponds to $CH_2$—$CH_2$ of the ethylene unit and the peak close to 3.0 ppm to 4.0 ppm corresponds to CH of the vinyl alcohol, the ratio of the integral values of these peaks is calculated and then the content ratio is calculated.

The melting point of the olefin copolymer including a hydroxyl group is preferably at least 90° C. and not more than 150° C. From the viewpoint of durability of the toner, the melting point is preferably at least 90° C. Further, where the melting point is not more than 150° C., the low-temperature fixability is improved, and the melting point is more preferably not more than 130° C., and even more preferably not more than 110° C. Further, by setting the melting point to not more than 150° C., the charge retention property is improved. The reason therefor is apparently that when the melting point is lowered, the amount of hydroxyl groups in the resin is decreased, hydroxyl groups undergo microphase separation in the olefin moiety, and the mobility of the hydroxyl groups decreases. The melting point of the olefin copolymer including a hydroxyl group can be controlled by controlling the content of the monomer unit (monomer unit Z2) including a hydroxyl group.

From the viewpoint of withstanding impacts and pressure at the time of using the toner, it is preferable that the softening point (Tm) of the olefin copolymer including a hydroxyl group in flow tester measurement be at least 100° C. and not more than 150° C. The softening point (Tm) of the olefin copolymer including a hydroxyl group can be measured in the same manner as the softening point of the olefin resin.

The softening point (Tm) can be controlled by changing the molecular weight of the olefin copolymer including a hydroxyl group, and the softening point can be increased by increasing the molecular weight.

The method for producing the olefin copolymer including a hydroxyl group is not particularly limited. An easy and preferable production method is to hydrolyze an ethylene-vinyl acetate copolymer. Specifically, the olefin copolymer including a hydroxyl group can be obtained by refluxing an ethylene-vinyl acetate copolymer including at least 4 mass % and not more than 34 mass % of a vinyl acetate-derived monomer unit in a mixed solvent of toluene and ethanol by using sodium hydroxide at 90° C.

The resin component preferably includes an olefin copolymer including an acid group. The acid value of the olefin copolymer including an acid group is preferably at least 50 mg KOH/g and not more than 300 mg KOH/g. As a result of including such an olefin copolymer including an acid group, the carboxyl groups of the olefin copolymer including an acid group form hydrogen bonds with the hydroxyl groups on the paper surface, and the adhesion between the toner and paper is further improved.

The olefin copolymer including an acid group refers to a resin obtained by random copolymerization, block copolymerization or graft copolymerization of a polyolefin such as polyethylene or polypropylene as a main component and a component having an acid group, and to a modification product of such a resin by a polymer reaction. Examples of the component having an acid group include acrylic acid, methacrylic acid, maleic acid, maleic anhydride, itaconic acid and vinyl sulfonate.

Further, a component other than the polyolefin and the component having the acid group may be also included as long as this component does not affect physical properties. The content of the monomer unit other than the polyolefin and the component having an acid group in the olefin copolymer including an acid group is preferably not more than 20 mass %, more preferably not more than 10 mass %, still preferably not more than 5 mass %, and particularly preferably substantially 0 mass %.

From the viewpoint of fixability, a copolymer of polyethylene as the main component and a component having an acid group is preferred. From the viewpoint of adhesion to paper, it is preferable that the component having an acid group be acrylic acid or methacrylic acid. Thus, from the viewpoint of improving the adhesion between the toner and paper, an ethylene-acrylic acid copolymer or an ethylene-methacrylic acid copolymer is preferred.

Further, an ethylene-methacrylic acid copolymer or an ethylene-acrylic acid copolymer has a melting point higher than that of the olefin copolymer including an ester group, and the inclusion of either of those copolymers improves storage property at high temperature.

In addition, where a toner is produced by an emulsion aggregation method described hereinbelow and the olefin copolymer including an acid group is included, cohesiveness is easily controlled by the acidic group of the olefin copolymer including an acid group and the particle size distribution is improved.

The content of the olefin copolymer including an acid group is preferably at least 10 mass % and less than 50 mass %, and more preferably at least 10 mass % and not more than 30 mass %, based on the total mass of the resin component. When the content is at least 10 mass %, adhesion to paper is improved. Further, when the content is not more than 30 mass %, the environment-induced fluctuation of charging performance is reduced.

The acid value of the olefin copolymer including an acid group is preferably at least 50 mg KOH/g and not more than 300 mg KOH/g, and more preferably at least 80 mg KOH/g and not more than 200 mg KOH/g. When the acid value is at least 50 mg KOH/g, the adhesion to paper is improved, and when the acid value is not more than 300 mg KOH/g, the charging performance is improved. Further, the acid value of the olefin copolymer including an acid group can be measured by the same method as that used for measuring the acid value of the olefin resin.

The softening point (Tm) of the olefin copolymer including an acid group in the flow tester measurement is preferably at least 100° C. In this case, blocking is unlikely to occur during storage. Further, from the viewpoint of adhesion between the toner and paper, the softening point (Tm) is preferably not more than 140° C. When the softening point (Tm) is not more than 140° C., the olefin copolymer including an acid group is compatible with the olefin resin present in the toner and the adhesion to paper of the entire toner is further improved. The softening point (Tm) of the olefin copolymer including an acid group can be measured by the same method as that used for measuring the softening point of the olefin resin.

From the viewpoint of low-temperature fixability and storage property, it is preferable that the melting point of the olefin copolymer including an acid group be at least 50° C. and not more than 100° C. When the melting point is not more than 100° C., the low-temperature fixability is further improved. Further, it is more preferable that the melting point be not more than 90° C., because the low-temperature fixability is further improved. Meanwhile, when the melting point is at least 50° C., the storage property is improved.

The melting point can be measured using a differential scanning calorimeter (DSC).

Specifically, a sample of 0.01 g to 0.02 g is precisely weighed in an aluminum pan, and the temperature is raised from 0° C. to 200° C. at a heating rate of 10° C./min to obtain a DSC curve.

The peak temperature of the maximum endothermic peak in the obtained DSC curve is taken as the melting point.

In addition to the olefin resin, the olefin copolymer including a hydroxyl group, and the olefin copolymer including an acid group, the resin component may also use another polymer as long as the effect of the present invention is not impaired.

Specific examples of other polymers include homopolymers of styrene, such as polystyrene, poly-p-chlorostyrene and polyvinyltoluene, and substitution products thereof; styrene copolymers such as styrene-p-chlorostyrene copolymer, styrene-vinyltoluene copolymer, styrene-vinylnaphthalene copolymer, styrene-acrylic acid ester copolymer and styrene-methacrylic acid ester copolymer; polyvinyl chloride, phenolic resins, phenolic resins modified with a natural resin, maleic resins modified with a natural resin, acrylic resins, methacrylic resins, polyvinyl acetate, silicone resins, polyester resins, polyurethane resins, polyamide resins, furan resins, epoxy resins and xylene resins.

It is preferable that a toner particle include an aliphatic hydrocarbon compound in an amount of at least 1 part by mass and not more than 40 parts by mass with respect to 100 parts by mass of the resin component. The melting point of the aliphatic hydrocarbon compound is preferably at least 50° C. and not more than 100° C., and more preferably at least 70° C. and not more than 100° C.

Where the aliphatic hydrocarbon compound is heated, the olefin resin can be plasticized. Therefore, when an aliphatic hydrocarbon compound is included in the toner particle, the olefin resin forming a matrix is plasticized at the time of thermal fixing of the toner and the low-temperature fixability can be enhanced. Further, the aliphatic hydrocarbon compound having a melting point of at least 50° C. and not more than 100° C. can also act as a nucleating agent for the olefin resin. Therefore, the micro-mobility of the olefin resin is suppressed and the charging performance is improved. From the viewpoints of low-temperature fixability and charging performance, it is preferable that the content of the aliphatic hydrocarbon compound be at least 10 parts by mass and not more than 30 parts by mass with respect to 100 parts by mass of the resin component.

Specific aliphatic hydrocarbon compounds can be exemplified by saturated hydrocarbons having 20 to 60 carbon atoms, such as hexacosane, triacontane and hexatriacontane.

Further, it is preferable that the toner particle include a silicone oil as a release agent. Release agents commonly used in toners, such as alkyl waxes, are likely to be compatible with the olefin resin and it is difficult to obtain a release effect. Further, when the toner particle includes a colorant, dispersibility with the colorant is improved by adding a silicone oil, and a high-density image is easily obtained.

Dimethyl silicone oil, methyl phenyl silicone oil, methyl hydrogen silicone oil, amino-modified silicone oil, carboxyl-modified silicone oil, alkyl-modified silicone oil, fluorine-modified silicone oil and the like can be used as the silicone oil. The viscosity of the silicone oil is preferably at least 5 $mm^2/S$ and not more than 1000 $mm^2/S$, and more preferably at least 20 $mm^2/S$ and not more than 1000 $mm^2/S$.

From the standpoint of obtaining satisfactory dispersibility while suppressing a decrease in fluidity, it is preferable that the content of the silicone oil be at least 1 part by mass and not more than 20 parts by mass with respect to 100 parts by mass of the resin component. More preferably, the content is at least 5 parts by mass and not more than 20 parts by mass.

The toner may include a colorant. Examples of the colorant are presented below.

Black colorants are exemplified by carbon black and colorants adjusted to a black color by using a yellow colorant, a magenta colorant, and a cyan colorant. As the colorant, a pigment may be used alone, but from the viewpoint of image quality of a full-color image, it is more preferable to use a dye and a pigment in combination to improve the image sharpness.

Examples of pigments for a magenta toner are presented below. C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, 282; C.I. Pigment Violet 19; and C.I. Vat Red 1, 2, 10, 13, 15, 23, 29, 35.

Examples of dyes for a magenta toner are presented below. Oil-soluble dyes such as C.I. Solvent Red 1, 3, 8, 23, 24, 25, 27, 30, 49, 81, 82, 83, 84, 100, 109, 121; C.I. Disperse Red 9; C.I. Solvent Violet 8, 13, 14, 21, 27; and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40; and C.I. Basic Violet 1, 3, 7, 10, 14, 15, 21, 25, 26, 27, 28.

Examples of pigments for a cyan toner are presented below. C.I. Pigment Blue 2, 3, 15:2, 15:3, 15:4, 16, 17; C.I. Vat Blue 6; C.I. Acid Blue 45; and copper phthalocyanine pigments in which at least 1 and not more than 5 phthalimidomethyl groups are substituted in the phthalocyanine skeleton.

A cyan toner dye can be exemplified by C.I. Solvent Blue 70.

Examples of pigments for a yellow toner are presented below. C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, 185; and C.I. Vat Yellow 1, 3, 20. A yellow toner dye can be exemplified by C.I. Solvent Yellow 162.

These colorants can be used singly or in a mixture, or in a solid solution state. The colorant is selected from the viewpoints of hue angle, saturation, lightness, light fastness, OHP transparency, and dispersibility in toner.

The content of the colorant is preferably at least 1 part by mass and not more than 20 parts by mass with respect to 100 parts by mass of the resin component.

From the viewpoint of obtaining a high-definition image, it is preferable that the volume-based median diameter of the toner be at least 3.0 μm and not more than 10.0 μm, and more preferably at least 4.0 μm and not more than 7.0 μm. The volume-based median diameter of the toner may be measured using a particle size distribution analyzer (Coulter Multisizer III: manufactured by Beckman Coulter, Inc.) according to a Coulter's method.

The present invention also provides a method for producing a toner including a toner particle including a resin component, the resin component including an olefin resin and an olefin copolymer including a hydroxyl group, the method comprising a preparation step of preparing a resin fine particle dispersion in which resin fine particles for producing the resin component are dispersed in an aqueous medium, wherein the olefin resin has a monomer unit Y1 represented by formula (1), the olefin copolymer including a hydroxyl group has a monomer unit Z1 represented by formula (2) and a monomer unit Z2 represented by formula (3), a hydroxyl value of the olefin resin is not more than 10 mg KOH/g, a hydroxyl value of the olefin copolymer including a hydroxyl group is at least 20 mg KOH/g and not more than 250 mg KOH/g, and a content of the olefin resin in the resin component is more than 50 mass % with respect to a total mass of the resin component.

As a result of preparing the resin fine particles in an aqueous medium to form a toner, the olefin copolymer including a hydroxyl group having a higher hydrophilicity is more likely to be unevenly distributed into the surface layer of the toner. As a result, the effect of the olefin copolymer including a hydroxyl group is more easily exhibited.

Among the methods for producing a toner, which include a step of dispersing toner particles including a resin component in an aqueous medium, an emulsion aggregation method is preferable from the viewpoint of particle size distribution controllability.

The emulsion aggregation method is a production method for producing toner particles by preparing in advance a dispersion of resin fine particles which are sufficiently small with respect to a target particle diameter and aggregating the resin fine particles in an aqueous medium.

It is preferable that the emulsion aggregation method further includes, after the preparation step of preparing the resin fine particle dispersion, an aggregation step of aggregating the resin fine particles to form aggregated particles; and a fusing step of heating and fusing the aggregated particles.

Furthermore, in addition to the abovementioned steps, a cooling step, a washing step, a drying step and the like may be implemented.

A method for producing the toner by using the emulsion aggregation method will be specifically described hereinbelow, but this method is not intended to be limiting.

<Preparation Step of Preparing Resin Fine Particle Dispersion>

A resin fine particle dispersion can be prepared by a known method, but the following method represents an advantageous example.

For example, a resin component is dissolved in an organic solvent to form a homogeneous solution. Thereafter, a basic compound or a surfactant is added as necessary. Further, an aqueous medium is added to this solution to form fine particles. Finally, the organic solvent is removed to prepare a resin fine particle dispersion in which resin fine particles are dispersed.

In the preparation step, the olefin resin, the olefin copolymer including a hydroxyl group and, if necessary, other resins may be separately dispersed, or two or more kinds of resin components may be made into resin fine particles by a co-emulsification method. It is also preferable to use a co-emulsification method in which the olefin copolymer including an acid group is added to the olefin resin or the olefin copolymer including a hydroxyl group at the time of emulsification for simultaneous dissolution and emulsification.

When the resin fine particles are formed by co-emulsification with the olefin copolymer including an acid group, the olefin resin or the olefin copolymer including a hydroxyl group is mixed with the olefin copolymer including an acid group in an organic phase. The compatibility of the two resins in the toner particle is enhanced, and the adhesion between the toner and paper is increased. More specifically, the olefin resin or the olefin copolymer including a hydroxyl group and the olefin copolymer including an acid group are heated and dissolved in an organic solvent, and a surfactant or a basic compound is added. Then, a co-emulsion (resin fine particle dispersion) including a resin is prepared by gradually adding an aqueous medium while applying shearing with a homogenizer or the like.

Alternatively, a co-emulsion including a resin is prepared by applying a shearing force with a homogenizer or the like after the aqueous medium has been added. Thereafter, the organic solvent is removed by heating or depressurization to prepare a resin fine particle dispersion.

When preparing the resin fine particle dispersion, it is preferable that the amount of the resin component to be dissolved in the organic solvent be at least 10 parts by mass and not more than 50 parts by mass, and more preferably at least 30 parts by mass and not more than 50 parts by mass, with respect to 100 parts by mass of the organic solvent.

As the organic solvent, any solvent capable of dissolving the resin component can be used, but a solvent having high solubility with respect to an olefin resin, such as toluene, xylene or ethyl acetate, is preferable.

The surfactant is not particularly limited. For example, anionic surfactants such as sulfuric acid esters, sulfonic acid salts, carboxylic acid salts, phosphoric acid esters, and soaps; cationic surfactants such as amine salts and quaternary ammonium salts; and nonionic surfactants such as polyethylene glycol, alkylphenol ethylene oxide adducts and polyhydric alcohols can be used.

Examples of the basic compound include inorganic bases such as sodium hydroxide and potassium hydroxide, and organic bases such as triethylamine, trimethylamine, dimethylaminoethanol and diethylaminoethanol. These basic compounds may be used singly or in combination of two or more thereof.

The volume-based median diameter of the resin fine particles is preferably from 0.05 μm to 1.0 μm, and more preferably from 0.1 μm to 0.6 μm. When the median diameter is within the above ranges, toner particles having a desired particle diameter are easily obtained. The volume-based median diameter can be measured with a dynamic light scattering type particle size distribution meter (Nanotrac UPA-EX 150: manufactured by Nikkiso Co., Ltd.).

<Aggregation Step>

The aggregation step is carried out, for example, by mixing a colorant fine particle dispersion, an aliphatic hydrocarbon fine particle dispersion, and a silicone oil emulsion with the resin fine particle dispersion to prepare a mixed liquid, and then aggregating the fine particles contained in the prepared mixed liquid to form aggregated particles. An example of the advantageous method for forming the aggregated particles involves adding/mixing a flocculant to the mixed liquid, raising the temperature, and appropriately adding mechanical power and the like.

The colorant fine particle dispersion is prepared by dispersing the colorant. The colorant fine particles are dispersed by a known method. For example, a media type dispersing machine such as a rotary shearing type homogenizer, a ball mill, a sand mill and an attritor, or a high pressure opposing collision type dispersing machine is preferably used. Further, if necessary, a surfactant or a polymer dispersant that imparts dispersion stability can be added.

The aliphatic hydrocarbon fine particle dispersion and the silicone oil emulsion are prepared by dispersing the respective materials in an aqueous medium. Each material is dispersed by a known method. For example, a media type dispersing machine such as a rotary shearing type homogenizer, a ball mill, a sand mill and an attritor, or a high pressure opposing collision type dispersing machine is preferably used. Further, if necessary, a surfactant or a polymer dispersant that imparts dispersion stability can be added.

Examples of the flocculant include salts of monovalent metals such as sodium and potassium; salts of divalent metals such as calcium and magnesium; salts of trivalent metals such as iron and aluminum; and salts of polyvalent metals such as aluminum polychloride. From the viewpoint of particle diameter controllability in the aggregation step, salts of divalent metals such as calcium chloride and magnesium sulfate are preferable.

The addition/mixing of the flocculant is preferably carried out in a temperature range from room temperature to 75° C. When mixing is carried out under this temperature condition, the aggregation proceeds in a stable state. The mixing can be carried out using a known mixing device, homogenizer, mixer or the like.

The volume-based median diameter of the aggregated particles formed in the aggregation step is not particularly limited, but usually may be controlled to about 4.0 μm to 7.0 μm so as to be about the same as the median diameter of the toner particles to be obtained. The control can be easily carried out, for example, by appropriately setting and changing the temperature at the time of addition/mixing of the flocculant and the like and the stirring and mixing conditions. The volume-based median diameter of the toner may be measured using a particle size distribution analyzer (Coulter Multisizer III: manufactured by Beckman Coulter, Inc.) according to a Coulter's method.

<Fusion Step>

In the fusion step, the aggregated particles are preferably heated to at least the melting point of the olefin resin and fused to produce particles having a smoothened aggregated particle surface. Before entering the primary fusion step, a chelating agent, a pH adjuster, a surfactant and the like can be appropriately added in order to prevent fusion between the obtained resin particles.

Examples of chelating agents include alkali metal salts such as ethylenediaminetetraacetic acid (EDTA) and a Na salt thereof, sodium gluconate, sodium tartrate, potassium citrate, sodium citrate, nitrotriacetate (NTA) salt, and a large number of water-soluble polymers (polymer electrolytes) including both COOH and OH functionalities.

The heating temperature is preferably at least the melting point of the olefin resin included in the aggregate and not more than the temperature at which the olefin resin or the olefin copolymer including a hydroxyl group is thermally decomposed. A short heating/fusing time is sufficient when the heating temperature is high, and a long heating/fusing time is required when the heating temperature is low. Thus, since the time of heating/fusing depends on the temperature of heating, it cannot be specified unconditionally, but it is generally about 10 min to 10 h.

<Cooling Step>

In the cooling step, it is preferable to cool the aqueous medium including the resin particles obtained in the fusion step to a temperature lower than the crystallization temperature of the olefin resin. Generation of coarse particles can be suppressed by performing cooling to a temperature lower than the crystallization temperature. The specific cooling rate is 0.1° C./min to 50° C./min.

Further, it is preferable to perform annealing to promote crystallization by maintaining the temperature at which the crystallization rate of the olefin resin is high during cooling or after cooling. By maintaining the temperature at 30° C. to 70° C., crystallization is promoted, and blocking resistance of the toner is improved.

<Washing Step>

Impurities in the resin particles can be removed by repeatedly washing and filtering the resin particles produced through the abovementioned steps. Specifically, it is preferable to wash the resin particles with an aqueous solution including a chelating agent such as ethylenediaminetetraacetic acid (EDTA) and a Na salt thereof, and then wash with pure water. By repeating washing with pure water and filtration a plurality of times, it is possible to remove metal salts and surfactant contained in the resin particles. From the viewpoint of production efficiency, the number of times of filtration is preferably 3 to 20, and more preferably 3 to 10.

<Drying Step>

The washed resin particles can be dried to obtain toner particles.

The toner particles may be directly used as a toner. If necessary, inorganic fine particles such as silica, alumina, titania and calcium carbonate, or fine particles of a resin such as a vinyl resin, a polyester resin and a silicone resin are added to the toner particles by applying a shearing force in a dry state, thereby obtaining the toner. These inorganic fine particles and resin fine particles function as external additives such as a fluidity aid and a cleaning aid.

EXAMPLES

Hereinafter, the present invention will be described in greater detail by way of examples and comparative examples, but embodiments of the present invention are not limited thereto. In the examples and comparative examples, the parts and percentages are all based on mass standard unless specified otherwise.

<Production of Olefin Copolymer EVOH-A Including Hydroxyl Group>

A total of 100 parts of the ethylene-vinyl acetate copolymer 1 (content of monomer unit derived from vinyl acetate: 15 mass %, acid value=0 mg KOH/g, Tm: 120° C., melting point: 105° C.) was dissolved in a mixed solvent including 500 mL of toluene and 500 mL of ethanol at 90° C. Then, 10 parts of sodium hydroxide was added and refluxing was carried out for 6 h. Subsequent washing with ethanol produced EVOH-A (ethylene-Poval copolymer). Physical properties of the obtained copolymer are shown in Table 1.

<Production of Olefin Copolymer EVOH-B Including Hydroxyl Group>

EVOH-B was produced in the same manner as EVOH-A except that the ethylene-vinyl acetate copolymer 2 (content of monomer unit derived from vinyl acetate: 28 mass %, acid value=0 mg KOH/g, Tm: 120° C., melting point: 110° C.) was used instead of the ethylene-vinyl acetate copolymer 1.

<Production of Olefin Copolymer EVOH-C Including Hydroxyl Group>

EVOH-C was produced in the same manner as EVOH-A except that the ethylene-vinyl acetate copolymer 3 (content of monomer unit derived from vinyl acetate: 15 mass %, acid value=0 mg KOH/g, Tm: 90° C., melting point: 95° C.) was used instead of the ethylene-vinyl acetate copolymer 1.

<Production of Olefin Copolymer EVOH-D Including Hydroxyl Group>

EVOH-D was produced in the same manner as EVOH-A except that the ethylene-vinyl acetate copolymer 4 (content of monomer unit derived from vinyl acetate: 5 mass %, acid value=0 mg KOH/g, Tm: 120° C., melting point: 106° C.) was used instead of the ethylene-vinyl acetate copolymer 1.

<Production of Resin Fine Particle A-1 Dispersion>

The following components were mixed and dissolved at 90° C.:

toluene (manufactured by Wako Pure Chemical Industries, Ltd.) . . . 300 parts, ethylene-vinyl acetate copolymer EVA-A ($R^1$=H, $R^4$=H, $R^5$=$CH_3$, content of the monomer unit represented by the general formulas (4) and (5) (content of the monomer unit Y2): 15 mass %, hydroxyl value=0 mg KOH/g, weight average molecular weight: 110,000, melting point: 86° C., softening point (Tm): 128° C., elongation at break=700%, (l+m+n)/W=1.00) . . . 100 parts, and olefin copolymer EMA-A including an acid group (ethylene-methacrylic acid copolymer, Tm=123° C., melting point=90° C., acid value=90 mg KOH/g) . . . 25 parts.

Separately, 0.7 parts of sodium dodecylbenzenesulfonate, 1.5 parts of sodium laurate, and 0.8 parts of N,N-dimethylaminoethanol were added to 700 parts of ion-exchanged water and dissolved by heating at 90° C. Next, the toluene solution and aqueous solution were mixed together, and stirring was performed at 7000 rpm using ultrahigh-speed stirrer T.K. Robomix (manufactured by PRIMIX Corporation).

Emulsification was then performed under a pressure of 200 MPa by using a high-pressure impact type disperser Nanomizer (manufactured by Yoshida Kikai Co., Ltd.). Thereafter, toluene was removed using an evaporator, and the concentration was adjusted with ion-exchanged water to obtain an aqueous dispersion having a concentration of resin fine particles A-1 of 20% (resin fine particle A-1 dispersion).

The volume-based median diameter of the resin fine particles A-1 was measured with a dynamic light scattering type particle size distribution meter (Nanotrac: manufactured by Nikkiso Co., Ltd.) and found to be 0.40 μm.

<Production of Resin Fine Particle A-2 Dispersion>

A resin fine particle A-2 dispersion was obtained in the same manner as in the method for producing the resin fine particle A-1 dispersion except that the olefin copolymer EMA-A including an acid group was not used. The volume-based median diameter of the obtained resin fine particles A-2 was 5.51 μm.

<Production of Resin Fine Particle A-3 Dispersion>

A resin fine particle A-3 dispersion was obtained in the same manner as in the method for producing the resin fine particle A-1 dispersion except that the olefin copolymer EMA-A including an acid group was changed to EMA-B (ethylene-methacrylic acid copolymer, Tm=130° C., melting point=95° C., acid value=33 mg KOH/g). The volume-based median diameter of the obtained resin fine particles A-3 was 0.50 μm.

<Production of Resin Fine Particle A-4 Dispersion>

A resin fine particle A-4 dispersion was obtained in the same manner as in the method for producing the resin fine particle A-1 dispersion except that EVA-A was changed to ethylene-vinyl acetate-styrene copolymer EVA-B ($R^1$=H, $R^4$=H, $R^5$=$CH_3$, content of monomer unit Y2: 15 mass %, polymerization ratio of ethylene unit/vinyl acetate unit/styrene unit: 81/15/4, hydroxyl value=0 mg KOH/g, melting point: 75° C., Tm: 130° C., elongation at break=600%, (l+m+n)/W=0.96). The volume-based median diameter of the obtained resin fine particles A-4 was 0.45 μm.

<Production of Resin Fine Particle A-5 Dispersion>

A resin fine particle A-5 dispersion was obtained in the same manner as in the method for producing the resin fine particle A-1 dispersion except that EVA-A was changed to ethylene-vinyl acetate-styrene copolymer EVA-C ($R^1$=H, $R^4$=H, $R^5$=$CH_3$, content of monomer unit Y2: 5 mass %, polymerization ratio of ethylene unit/vinyl acetate unit/styrene unit: 70/5/25, hydroxyl value=0 mg KOH/g, melting point: 71° C., Tm: 118° C., elongation at break=550%, (l+m+n)/W=0.75). The volume-based median diameter of the obtained resin fine particles A-5 was 0.42 μm.

<Production of Resin Fine Particle A-6 Dispersion>

A resin fine particle A-6 dispersion was obtained in the same manner as in the method for producing the resin fine particle A-1 dispersion except that EVA-A was changed to ethylene-ethyl acrylate copolymer EEA-A ($R^1$=H, $R^6$=H, $R^7$=$C_2H_5$, content of monomer unit Y2: 15 mass %, acid value=0 mg KOH/g, melting point: 87° C., Tm: 125° C., elongation at break=800%, (l+m+n)/W=1.00). The volume-based median diameter of the obtained resin fine particles A-6 was 0.41 μm.

<Production of Resin Fine Particle A-7 Dispersion>

A resin fine particle A-7 dispersion was obtained in the same manner as in the method for producing the resin fine particle A-1 dispersion except that EVA-A was changed to polyethylene PE-A ($R^1$=H, content of monomer unit Y2: 0 mass %, acid value=0 mg KOH/g, melting point: 110° C., Tm: 125° C., elongation at break=500%, (l+m+n)/W=1.00). The volume-based median diameter of the obtained resin fine particles A-7 was 0.75 μm.

<Production of Resin Fine Particle A-8 Dispersion>

A resin fine particle A-8 dispersion was obtained in the same manner as in the method for producing the resin fine particle A-1 dispersion except that EVA-A was changed to EVA-D ($R^1$=H, $R^4$=H, $R^5$=$CH_3$, content of monomer unit Y2: 37 mass %, hydroxyl value=0 mg KOH/g, melting point: 45° C., Tm: 150° C., elongation at break=600%, (l+m+n)/W=1.00). The volume-based median diameter of the obtained resin fine particles A-8 was 0.50 μm.

<Production of Resin Fine Particle A-9 Dispersion>

A resin fine particle A-9 dispersion was obtained in the same manner as in the method for producing the resin fine particle A-1 dispersion except that EVA-A was changed to EVA-E ($R^1$=H, $R^4$=H, $R^5$=$CH_3$, content of monomer unit Y2: 28 mass %, hydroxyl value=0 mg KOH/g, melting point: 69° C., Tm: 110° C., elongation at break=800%, (l+m+n)/W=1.00). The volume-based median diameter of the obtained resin fine particles A-9 was 0.45 μm.

<Production of Resin Fine Particle A-10 Dispersion>

A resin fine particle A-10 dispersion was obtained in the same manner as in the method for producing the resin fine particle A-1 dispersion except that EVA-A was changed to EVA-F ($R^1$=H, $R^4$=H, $R^5$=$CH_3$, content of monomer unit Y2: 2 mass %, hydroxyl value=0 mg KOH/g, melting point: 105° C., Tm: 160° C., elongation at break=600%, (l+m+n)/W=1.00). The volume-based median diameter of the obtained resin fine particles A-10 was 0.44 μm.

<Production of Resin Fine Particle B-1 Dispersion>

A resin fine particle B-1 dispersion was obtained in the same manner as in the method for producing the resin fine particle A-1 dispersion except that EVA-A was changed to ethylene-Poval EVOH-A ($R^2$=H, $R^3$=H, content of the monomer unit represented by the general formula (3): 8.1 mass %, hydroxyl value=99 mg KOH/g, melting point: 105° C., Tm: 120° C.). The volume-based median diameter of the obtained resin fine particles B-1 was 0.40 μm.

<Production of Resin Fine Particle B-2 Dispersion>

A resin fine particle B-2 dispersion was obtained in the same manner as in the method for producing the resin fine particle A-1 dispersion except that EVA-A was changed to ethylene-Poval EVOH-B ($R^2$=H, $R^3$=H, content of the monomer unit represented by the general formula (3): 16 mass %, hydroxyl value=200 mg KOH/g, melting point: 110° C., Tm: 120° C.). The volume-based median diameter of the obtained resin fine particles B-2 was 0.42 μm.

<Production of Resin Fine Particle B-3 Dispersion>

A resin fine particle B-3 dispersion was obtained in the same manner as in the method for producing the resin fine particle A-1 dispersion except that EVA-A was changed to ethylene-Poval EVOH-C($R^2$=H, $R^3$=H, content of the monomer unit represented by the general formula (3): 8.1 mass %, hydroxyl value=99 mg KOH/g, melting point: 95° C., Tm: 90° C.). The volume-based median diameter of the obtained resin fine particles B-3 was 0.44 μm.

<Production of Resin Fine Particle B-4 Dispersion>

A resin fine particle B-4 dispersion was obtained in the same manner as in the method for producing the resin fine particle A-1 dispersion except that EVA-A was changed to ethylene-Poval EVOH-D ($R^2$=H, $R^3$=H, content of the monomer unit represented by the general formula (3): 2.6 mass %, hydroxyl value=33 mg KOH/g, melting point: 106° C., Tm: 120° C.). The volume-based median diameter of the obtained resin fine particles B-4 was 0.42 μm.

<Production of Resin Fine Particle B-5 Dispersion>

A resin fine particle B-5 dispersion was obtained in the same manner as in the method for producing the resin fine particle A-1 dispersion except that EVA-A was changed to ethylene-Poval EVOH-A ($R^2$=H, $R^3$=H, content of the monomer unit represented by the general formula (3): 8.1 mass %, hydroxyl value=99 mg KOH/g, melting point: 105° C., Tm: 120° C.) and the olefin copolymer EMA-A including an acid group was not used. The volume-based median diameter of the obtained resin fine particles B-5 was 1.25 μm.

<Production of Resin Fine Particle B-6 Dispersion>

A resin fine particle B-6 dispersion was obtained in the same manner as in the method for producing the resin fine particle A-1 dispersion except that EVA-A was changed to ethylene-Poval EVOH-A ($R^2$=H, $R^3$=H, content of the monomer unit represented by the general formula (3): 8.1 mass %, hydroxyl value=99 mg KOH/g, melting point: 105° C., Tm: 120° C.), and the olefin copolymer EMA-A including an acid group was changed to the olefin copolymer EMA-B including an acid group (ethylene-methacrylic acid copolymer, Tm: 130° C., melting point: 95° C., acid value=33 mg KOH/g). The volume-based median diameter of the obtained resin fine particles B-6 was 0.52 μm.

<Production of Resin Fine Particle B-7 Dispersion>

A resin fine particle B-7 dispersion was obtained in the same manner as in the method for producing the resin fine particle A-1 dispersion except that EVA-A was changed to commercial ethylene-Poval EVOH-E (Soarnol AT 4412, manufactured by Nippon Synthetic Chemical Industry Co., Ltd., $R^2$=H, $R^3$=H, content of the monomer unit represented by the general formula (3): 67 mass %, hydroxyl value=680 mg KOH/g, melting point: 164° C., Tm: 120° C.). The volume-based median diameter of the obtained resin fine particles B-7 was 1.33 μm.

<Production of Resin Fine Particle B-8 Dispersion>

A resin fine particle B-8 dispersion was obtained in the same manner as in the method for producing the resin fine particle A-1 dispersion except that EVA-A was changed to commercial ethylene-Poval EVOH-F (Soarnol DC 3212, manufactured by Nippon Synthetic Chemical Industry Co., Ltd., $R^2$=H, $R^3$=H, content of the monomer unit represented by the general formula (3): 77 mass %, hydroxyl value=976 mg KOH/g, melting point: 183° C., Tm: 120° C.). The volume-based median diameter of the obtained resin fine particles B-8 was 1.50 μm.

<Production of Resin Fine Particle B-9 Dispersion>

A resin fine particle B-9 dispersion was obtained in the same manner as in the method for producing the resin fine particle A-1 dispersion except that EVA-A was changed to ethylene-Poval EVOH-G ($R^2$=H, $R^3$=H, content of the monomer unit represented by the general formula (3): 1.3 mass %, hydroxyl value=16 mg KOH/g, melting point: 100° C., Tm: 115° C.). The volume-based median diameter of the obtained resin fine particles B-9 was 0.45 μm.

<Production of Resin Fine Particle C Dispersion>

The following components:

tetrahydrofuran (manufactured by Wako Pure Chemical Industries, Ltd.) . . . 200 parts, crystalline polyester resin . . . 120 parts [Composition (mol %) [1,9-nonanediol: sebacic acid=100:100], SP value=19.7, number average molecular weight (Mn)=5500, weight average molecular weight (Mw)=15,500, peak molecular weight (Mp)=11,400, melting point=78° C., acid value=13 mg KOH/g], and anionic surfactant (Neogen RK, manufactured by DKS Co. Ltd.) . . . 0.6 parts were mixed and the mixture was heated to 50° C. and stirred for 3 h to dissolve the resin.

Then, 2.7 parts of N,N-dimethylaminoethanol was added, followed by stirring at 4000 rpm with ultrahigh-speed stirrer T.K. Robomix (manufactured by PRIMIX Corporation).

Further, 360 parts of ion-exchanged water was added at a rate of 1 g/min to precipitate resin fine particles. Thereafter, tetrahydrofuran was removed using an evaporator, and the concentration was adjusted with ion-exchanged water to obtain an aqueous dispersion (crystalline resin fine particle C dispersion) having a concentration of 20% of crystalline resin fine particles C. The volume-based median diameter of the obtained resin fine particles C was 0.30 μm.

<Production of Colorant Fine Particle Dispersion>

The following components:

colorant . . . 10.0 parts (cyan pigment, Pigment Blue 15:3, manufactured by Dainichiseika Color & Chemicals Mfg. Co., Ltd.), anionic surfactant (Neogen RK, manufactured by DKS Co. Ltd.) . . . 1.5 parts, and ion-exchanged water . . . 88.5 parts were mixed and dissolved, followed by dispersing for about 1 h using a high-pressure impact type disperser Nanomizer (manufactured by Yoshida Kikai Co., Ltd.) to prepare an aqueous dispersion of colorant fine particles having a concentration of 10% (colorant fine particle dispersion). The volume-based median diameter of the obtained colorant fine particles was measured with a dynamic light scattering type particle size distribution meter (Nanotrac: manufactured by Nikkiso Co., Ltd.) and found to be 0.20 μm.

<Production of Aliphatic Hydrocarbon Fine Particle Dispersion>

The following components:

aliphatic hydrocarbon compound (HNP-51, melting point 78° C., manufactured by Nippon Seiro Co., Ltd.) . . . 20.0 parts, anionic surfactant (Neogen RK, manufactured by DKS Co. Ltd.) . . . 1.0 part, and ion-exchanged water . . . 79.0 parts were charged in a mixing container equipped with a stirring device, heated to 90° C., and circulated to Clearmix W Motion (manufactured by M Technique Co., Ltd.) to perform dispersion treatment for 60 min. The conditions of the dispersion treatment were as follows.

Rotor outer diameter: 3 cm

Clearance: 0.3 mm

Rotor revolution speed: 19,000 r/min

Screen revolution speed: 19,000 r/min

After the dispersion treatment, the dispersion was cooled to 40° C. under cooling treatment conditions of a rotor revolution speed of 1000 r/min, a screen revolution speed of 0 r/min, and a cooling rate of 10° C./min, whereby an aqueous dispersion with a 20% concentration of aliphatic hydrocarbon fine particles (aliphatic hydrocarbon fine particle dispersion) was obtained. The volume-based median diameter of the aliphatic hydrocarbon fine particles was measured with a dynamic light scattering type particle size distribution meter (Nanotrac: manufactured by Nikkiso Co., Ltd.) and found to be 0.15 μm.

<Production of Silicone Oil Emulsion>

The following components:

silicone oil . . . 20.0 parts (dimethylsilicone oil manufactured by Shin-Etsu Chemical Co., Ltd.: KF 96-50 CS), anionic surfactant (Neogen RK, manufactured by DKS Co. Ltd.) . . . 1.0 part, and ion-exchanged water . . . 79.0 parts were mixed, dissolved, and dispersed for about 1 h by using a high-pressure impact disperser Nanomizer (manufactured by Yoshida Kikai Co., Ltd.) to prepare an aqueous dispersion of silicone oil having a silicone oil concentration of 20%. The volume-based median diameter of the aliphatic hydrocarbon fine particles was measured with a dynamic light scattering type particle size distribution meter (Nanotrac: manufactured by Nikkiso Co., Ltd.) and found to be 0.09 μm.

Example 1: Production of Toner 1

The following materials:

resin fine particle A-1 dispersion . . . 400 parts, resin fine particle B-1 dispersion . . . 100 parts, colorant particle dispersion . . . 80 parts, aliphatic hydrocarbon compound fine particle dispersion . . . 150 parts, silicone oil emulsion . . . 50 parts, and ion-exchanged water . . . 160 parts were charged into a round stainless steel flask and mixed. Then, 60 parts of a 10% aqueous solution of magnesium sulfate was added. Subsequently, the mixture was dispersed for 10 min at 5000 r/min by using a homogenizer (Ultra Turrax T50, manufactured by IKA). Then, the dispersion was heated to 73° C. while appropriately adjusting the revolution rate at which the mixture was stirred by using a stirring blade in a heating water bath. After holding for 20 min at 73° C., it was confirmed that the volume-based median diameter of the obtained aggregated particles was about 6.0 μm.

A total of 330 parts of a 5% aqueous solution of sodium salt of ethylenediaminetetraacetic acid was added, followed by heating to 98° C. under continuous stirring. Subsequent holding for 1 h at 98° C. resulted in fusion of the aggregated particles.

The mixture was then cooled to 50° C. and held for 3 h to promote crystallization of the ethylene-vinyl acetate copolymer. The mixture was thereafter cooled to 25° C., filtered, and solid-liquid separated. The filtrate was washed with a 0.5% aqueous solution of sodium salt of ethylenediaminetetraacetic acid and further washed with ion-exchanged water. After completion of washing, the copolymer was dried using a vacuum dryer to obtain toner particles having a volume-based median diameter of 5.5 μm.

A total of 1.5 parts of hydrophobized silica fine powder having a primary particle diameter of 10 nm and 2.5 parts of hydrophobized silica fine powder having a primary particle diameter of 100 nm were dry mixed with 100 parts of the obtained toner particles by using a Henschel mixer (manufactured by Mitsui Mining Co., Ltd.) to obtain a Toner 1. The constitution conditions of the obtained Toner 1 are shown in Table 1.

Example 2

A Toner 2 was obtained in the same manner as in Example 1 except that the resin fine particle B-1 dispersion was changed to the resin fine particle B-2 dispersion. The volume-based median diameter of the obtained Toner 2 was 5.4 μm.

Example 3

A Toner 3 was obtained in the same manner as in Example 1 except that the resin fine particle B-1 dispersion was changed to the resin fine particle B-3 dispersion. The volume-based median diameter of the obtained Toner 3 was 5.3 μm.

Example 4

A Toner 4 was obtained in the same manner as in Example 1 except that the resin fine particle B-1 dispersion was changed to the resin fine particle B-4 dispersion. The volume-based median diameter of the obtained Toner 4 was 5.5 μm.

Example 5

A Toner 5 was obtained in the same manner as in Example 1, except that the resin fine particle A-1 dispersion was changed to the resin fine particle A-2 dispersion and the resin fine particle B-1 dispersion was changed to the resin fine particle B-5 dispersion. The volume-based median diameter of the obtained Toner 5 was 7.5 μm.

Example 6

A Toner 6 was obtained in the same manner as in Example 1 except that the aliphatic hydrocarbon fine particle dispersion was not used. The volume-based median diameter of the obtained Toner 6 was 5.4 μm.

Example 7

A Toner 7 was obtained in the same manner as in Example 1 except that the aliphatic hydrocarbon fine particle dispersion and the silicone oil emulsion were not used. The volume-based median diameter of the obtained Toner 7 was 5.3 μm.

Example 8

A Toner 8 was obtained in the same manner as in Example 1 except that the resin fine particle A-1 dispersion was changed to the resin fine particle A-3 dispersion and the resin fine particle B-1 dispersion was changed to the resin fine particle B-6 dispersion. The volume-based median diameter of the obtained Toner 8 was 5.4 μm.

Example 9

A Toner 9 was obtained in the same manner as in Example 1 except that the resin fine particle A-1 dispersion was changed to the resin fine particle A-4 dispersion. The volume-based median diameter of the obtained Toner 9 was 5.4 μm.

Example 10

A Toner 10 was obtained in the same manner as in Example 1 except that the resin fine particle A-1 dispersion was changed to the resin fine particle A-5 dispersion. The volume-based median diameter of the obtained Toner 10 was 5.4 μm.

Example 11

A Toner 11 was obtained in the same manner as in Example 1 except that the resin fine particle A-1 dispersion was changed to the resin fine particle A-6 dispersion. The volume-based median diameter of the obtained Toner 11 was 5.3 μm.

Example 12

A Toner 12 was obtained in the same manner as in Example 1 except that the amount of the resin fine particle A-1 dispersion was changed to 475 parts and the amount of the resin fine particle B-1 dispersion was changed to 25 parts. The volume-based median diameter of the obtained Toner 12 was 5.4 μm.

Example 13

A Toner 13 was obtained in the same manner as in Example 1 except that the resin fine particle A-1 dispersion was changed to the resin fine particle A-7 dispersion. The volume-based median diameter of the obtained Toner 13 was 5.3 μm.

Example 14

A Toner 14 was obtained in the same manner as in Example 1 except that the resin fine particle A-1 dispersion was changed to the resin fine particle A-8 dispersion. The volume-based median diameter of the obtained Toner 14 was 5.3 μm.

Example 15

A Toner 15 was obtained in the same manner as in Example 1 except that the resin fine particle A-1 dispersion was changed to the resin fine particle A-9 dispersion. The volume-based median diameter of the obtained Toner 15 was 5.4 μm.

Example 16

A Toner 16 was obtained in the same manner as in Example 1 except that the resin fine particle A-1 dispersion was changed to the resin fine particle A-10 dispersion. The volume-based median diameter of the obtained Toner 16 was 5.4 μm.

Comparative Example 1

A Toner 17 was obtained in the same manner as in Example 1 except that the resin fine particle A-1 dispersion was changed to the resin fine particle A-2 dispersion, and the resin fine particle B-1 dispersion was not used. The volume-based median diameter of the obtained Toner 17 was 10.3 μm.

Comparative Example 2

A Toner 18 was obtained in the same manner as in Example 1 except that the resin fine particle B-1 dispersion was changed to the resin fine particle B-7 dispersion. The volume-based median diameter of the obtained Toner 18 was 6.5 μm.

Comparative Example 3

A Toner 19 was obtained in the same manner as in Example 1 except that the resin fine particle B-1 dispersion was changed to the resin fine particle B-8 dispersion. The volume-based median diameter of the obtained Toner 19 was 7.4 μm.

Comparative Example 4

A Toner 20 was obtained in the same manner as in Example 1 except that the amount of the resin fine particle A-1 dispersion was changed to 250 parts, the amount of the resin fine particle B-1 dispersion was changed to 100 parts, and the amount of the resin fine particle C dispersion was changed to 150 parts. The volume-based median diameter of the obtained Toner 20 was 5.3 μm.

Comparative Example 5

A Toner 21 was obtained in the same manner as in Example 1 except that the resin fine particle B-1 dispersion was changed to the resin fine particle B-9 dispersion. The volume-based median diameter of the obtained Toner 21 was 5.5 μm.

The following evaluation tests were conducted using the Toners 1 to 21. The evaluation results are shown in Table 2.

<Evaluation of Storage Stability (Blocking Resistance)>

The toner was allowed to stand for 7 days in a thermo-hygrostat at a temperature of 50° C. and a humidity of 54% RH, and the extent of blocking was visually evaluated.

A: Blocking does not occur or even if blocking occurs, the particles are easily dispersed by light vibration.

B: Blocking occurs, but the particles are dispersed by continuous vibration.

C: Blocking occurs and the particles are not dispersed even when applying force.

Evaluation of Low-Temperature Fixability

A two-component developer was prepared by mixing the toner and a ferrite carrier (average particle size 42 μm) coated with a silicone resin so that the toner concentration was 8 mass %. An unfixed toner image (0.75 mg/cm$^2$) was formed on an image receiving paper (64 g/m$^2$) using a commercially available full-color digital copier (CLC 1100, manufactured by Canon Inc.). A fixing unit removed from a commercially available full-color digital copier (imageRUNNER ADVANCE C5051, manufactured by Canon Inc.) was modified so that the fixing temperature could be adjusted, and a fixing test of unfixed images was carried out using the modified fixing unit. Under the environment of a room temperature of 15° C. and a humidity of 10% RH, the process speed was set to 357 mm/sec, and the fixing state of the unfixed image was visually evaluated.

A: Fixing is possible at a temperature not more than 140° C.

B: Fixing is possible at a temperature higher than 140° C. and not more than 150° C.

C: Fixing is possible at a temperature higher than 150° C. or there is no temperature range where fixing is possible.

<Evaluation of Eraser Rubbing Resistance>

The toner was fixed by the same method as in the evaluation of low-temperature fixability and eraser rubbing resistance of the fixed matter at the maximum fixable temperature was tested with an eraser (product name: MONO, manufactured by Tombow Pencil Co., Ltd.).

A: The fixed matter is not erased with the eraser.

B: The image density decreases by erasing with the eraser.

C: The fixed matter is erased with the eraser.

<Evaluation of Charge Retention Rate>

A total of 0.01 g of the toner was weighed into an aluminum pan and charged to −600 V by using a scorotron charging device. Variation in surface potential was then measured for 30 min in an atmosphere of temperature of 30° C. and humidity of 80% RH by using a surface electrometer (model 347 manufactured by Trek Japan Co., Ltd.). From the measured results, the charge retention rate was calculated using the following formula. Charge retention property was evaluated based on the charge retention rate.

Charge retention rate (%) after 30 min=[(Surface potential after 30 min)/(Initial surface potential)]×100

A: Charge retention rate is at least 90%.

B: Charge retention rate is at least 50% and less than 90%.

C: Charge retention rate is at least 10% and less than 50%.

D: Charge retention rate is less than 10%.

TABLE 1

| Example No. | Fine particle dispersion No | | Olefin resin Type | Content with respect to total mass of resin component (mass %) | Effective component (mass %) | Content of Y2 (mass %) | Hydroxyl value (mg KOH/g) | Melting point | Tm | Olefin copolymer including a hydroxyl group Type |
|---|---|---|---|---|---|---|---|---|---|---|
| 1 | A-1 | B-1 | EVA-A | 64 | 100 | 15 | 0 | 86° C. | 128° C. | EVOH-A |
| 2 | A-1 | B-2 | EVA-A | 64 | 100 | 15 | 0 | 86° C. | 128° C. | EVOH-B |
| 3 | A-1 | B-3 | EVA-A | 64 | 100 | 15 | 0 | 86° C. | 128° C. | EVOH-C |
| 4 | A-1 | B-4 | EVA-A | 64 | 100 | 15 | 0 | 86° C. | 128° C. | EVOH-D |
| 5 | A-2 | B-5 | EVA-A | 75 | 100 | 15 | 0 | 86° C. | 128° C. | EVOH-A |
| 6 | A-1 | B-1 | EVA-A | 64 | 100 | 15 | 0 | 86° C. | 128° C. | EVOH-A |
| 7 | A-1 | B-1 | EVA-A | 64 | 100 | 15 | 0 | 86° C. | 128° C. | EVOH-A |
| 8 | A-3 | B-6 | EVA-A | 64 | 100 | 15 | 0 | 86° C. | 128° C. | EVOH-A |
| 9 | A-4 | B-1 | EVA-B | 64 | 96 | 15 | 0 | 75° C. | 130° C. | EVOH-A |
| 10 | A-5 | B-1 | EVA-C | 64 | 75 | 5 | 0 | 71° C. | 118° C. | EVOH-A |
| 11 | A-6 | B-1 | EVA-A | 64 | 100 | 15 | 0 | 87° C. | 125° C. | EVOH-A |
| 12 | A-1 | B-1 | EVA-A | 76 | 100 | 15 | 0 | 86° C. | 128° C. | EVOH-A |
| 13 | A-7 | B-1 | PE-A | 64 | 100 | 0 | 0 | 110° C. | 125° C. | EVOH-A |
| 14 | A-8 | B-1 | EVA-D | 64 | 100 | 37 | 0 | 45° C. | 150° C. | EVOH-A |
| 15 | A-9 | B-1 | EVA-E | 64 | 100 | 28 | 0 | 69° C. | 110° C. | EVOH-A |
| 16 | A-10 | B-1 | EVA-F | 64 | 100 | 2 | 0 | 105° C. | 160° C. | EVOH-A |
| Comparative 1 | A-2 | — | EVA-A | 100 | 100 | 15 | 0 | 86° C. | 128° C. | — |
| Comparative 2 | A-1 | B-7 | EVA-A | 64 | 100 | 15 | 0 | 86° C. | 128° C. | EVOH-E |
| Comparative 3 | A-1 | B-8 | EVA-A | 64 | 100 | 15 | 0 | 86° C. | 128° C. | EVOH-F |
| Comparative 4 | A-1 | B-1 | EVA-A | 40 | 100 | 15 | 0 | 86° C. | 128° C. | EVOH-A |
| Comparative 5 | A-1 | B-9 | EVA-A | 64 | 100 | 15 | 0 | 86° C. | 128° C. | EVOH-G |

| Example No. | Olefin copolymer including a hydroxyl group: Content with respect to total mass of resin component (mass %) | Content of unit represented by formula (3) (mass %) | Hydroxyl value (mg KOH/g) | Melting point | Tm | Olefin copolymer including an acid group: Type | Content (mass %) | Amount with respect to 100 parts of resin component: Aliphatic hydrocarbon compound (parts) | Silcone oil (parts) |
|---|---|---|---|---|---|---|---|---|---|
| 1 | 16 | 8.1 | 99 | 105° C. | 120° C. | EMA-A | 20 | 30 | 10 |
| 2 | 16 | 16 | 200 | 110° C. | 120° C. | EMA-A | 20 | 30 | 10 |
| 3 | 16 | 8.1 | 99 | 95° C. | 90° C. | EMA-A | 20 | 30 | 10 |
| 4 | 16 | 2.6 | 33 | 106° C. | 120° C. | EMA-A | 20 | 30 | 10 |
| 5 | 25 | 8.1 | 99 | 105° C. | 120° C. | — | — | 30 | 10 |
| 6 | 16 | 8.1 | 99 | 105° C. | 120° C. | EMA-A | 20 | — | 10 |
| 7 | 16 | 8.1 | 99 | 105° C. | 120° C. | EMA-A | 20 | — | — |
| 8 | 16 | 8.1 | 99 | 105° C. | 120° C. | EMA-B | 20 | 30 | 10 |
| 9 | 16 | 8.1 | 99 | 105° C. | 120° C. | EMA-A | 20 | 30 | 10 |
| 10 | 16 | 8.1 | 99 | 105° C. | 120° C. | EMA-A | 20 | 30 | 10 |
| 11 | 16 | 8.1 | 99 | 105° C. | 120° C. | EMA-A | 20 | 30 | 10 |
| 12 | 4 | 8.1 | 99 | 105° C. | 120° C. | EMA-A | 20 | 30 | 10 |
| 13 | 16 | 8.1 | 99 | 105° C. | 120° C. | EMA-A | 20 | 30 | 10 |
| 14 | 16 | 8.1 | 99 | 105° C. | 120° C. | EMA-A | 20 | 30 | 10 |
| 15 | 16 | 8.1 | 99 | 105° C. | 120° C. | EMA-A | 20 | 30 | 10 |
| 16 | 16 | 8.1 | 99 | 105° C. | 120° C. | EMA-A | 20 | 30 | 10 |
| Comparative 1 | — | — | — | — | — | — | — | 30 | 10 |
| Comparative 2 | 16 | 67 | 680 | 164° C. | 120° C. | EMA-A | 20 | 30 | 10 |
| Comparative 3 | 16 | 77 | 976 | 183° C. | 120° C. | EMA-A | 20 | 30 | 10 |
| Comparative 4 | 16 | 8.1 | 99 | 105° C. | 120° C. | EMA-A | 14 | 30 | 10 |
| Comparative 5 | 16 | 1.3 | 16 | 100° C. | 115° C. | EMA-A | 20 | 30 | 10 |

In the table, the effective component refers to the content of the monomer units Y1 and Y2 in the olefin resin.

TABLE 2

| Example No. | Toner evaluation results: Low-temperature fixability | Charge retention rate | Storage stability | eraser rubbing resistance |
|---|---|---|---|---|
| 1 | A | A | A | A |
| 2 | A | A | A | A |

TABLE 2-continued

| Example No. | Toner evaluation results: Low-temperature fixability | Charge retention rate | Storage stability | eraser rubbing resistance |
|---|---|---|---|---|
| 3 | A | A | B | A |
| 4 | A | A | A | B |
| 5 | A | A | A | B |
| 6 | B | A | A | A |
| 7 | B | A | A | A |

TABLE 2-continued

| Example No. | Toner evaluation results | | | |
|---|---|---|---|---|
| | Low-temperature fixability | Charge retention rate | Storage stability | eraser rubbing resistance |
| 8 | A | A | A | A |
| 9 | A | A | A | A |
| 10 | B | B | B | A |
| 11 | A | A | A | A |
| 12 | A | A | A | B |
| 13 | B | A | A | B |
| 14 | A | C | C | A |
| 15 | A | B | B | A |
| 16 | B | A | A | A |
| Comparative 1 | B | A | A | C |
| Comparative 2 | C | C | A | A |
| Comparative 3 | C | C | A | A |
| Comparative 4 | C | D | A | A |
| Comparative 5 | B | A | A | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-203712, filed Oct. 17, 2016, and Japanese Patent Application No. 2017-173392, filed Sep. 8, 2017, which are hereby incorporated by reference herein in their entirety.

What is claimed is:

1. A toner comprising a toner particle including a resin component, wherein the resin component includes an olefin resin and an olefin copolymer including a hydroxyl group, the olefin resin has a monomer unit Y1 represented by a following formula (1), the olefin copolymer including a hydroxyl group has a monomer unit Z1 represented by a following formula (2) and a monomer unit Z2 represented by a following formula (3), a hydroxyl value of the olefin resin is not more than 10 mg KOH/g, a hydroxyl value of the olefin copolymer including a hydroxyl group is at least 20 mg KOH/g and not more than 250 mg KOH/g, and a content of the olefin resin in the resin component is more than 50 mass % with respect to a total mass of the resin component:

(1)

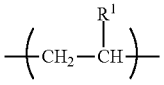

(2)

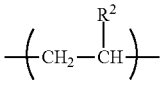

(3)

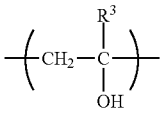

(where, $R^1$ represents H or $CH_3$, $R^2$ represents H or $CH_3$, and $R^3$ represents H or $CH_3$).

2. The toner according to claim 1, wherein the olefin resin has a monomer unit Y1 represented by a following formula (1) and at least one monomer unit Y2 selected from the group consisting of a monomer unit represented by a following formula (4) and a monomer unit represented by a following formula (5); and a content of the monomer unit Y2 is at least 3 mass % and not more than 35 mass % with respect to a total mass of the olefin resin:

(1)

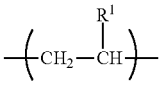

(4)

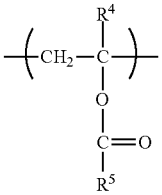

(5)

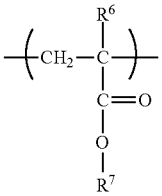

(where $R^1$ represents H or $CH_3$, $R^4$ represents H or $CH_3$, $R^5$ represents $CH_3$ or $CH_2CH_3$, $R^6$ represents H or $CH_3$, and $R^7$ represents $CH_3$ or $CH_2CH_3$).

3. The toner according to claim 2, wherein where the total mass of the olefin resin is denoted by W, and masses of the monomer unit represented by formula (1), the monomer unit represented by formula (4) and the monomer unit represented by formula (5) are denoted by l, m, and n respectively, a value of (l+m+n)/W of the olefin resin is at least 0.80.

4. The toner according to claim 2, wherein the content of the monomer unit Y2 is at least 5 mass % and not more than 20 mass % with respect to the total mass of the olefin resin.

5. The toner according to claim 1, wherein a melting point of the olefin copolymer including a hydroxyl group is at least 90° C. and not more than 150° C.

6. The toner according to claim 1, wherein a softening point (Tm) of the olefin copolymer including a hydroxyl group is at least 100° C. and not more than 150° C.

7. The toner according to claim 1, wherein the resin component comprises an olefin copolymer including an acid group which has an acid value of at least 50 mg KOH/g and not more than 300 mg KOH/g.

8. The toner according to claim 1, wherein the content of the olefin copolymer including a hydroxyl group is at least 10 mass % and less than 50 mass % with respect to the total mass of the resin component.

9. The toner according to claim 1, wherein a softening point (Tm) of the olefin resin is at least 120° C. and not more than 160° C.

10. The toner according to claim 1, wherein the toner particle includes an aliphatic hydrocarbon compound having a melting point of at least 50° C. and not more than 100° C.; and a content of the aliphatic hydrocarbon compound is at least 1 part by mass and not more than 40 parts by mass with respect to 100 parts by mass of the resin component.

11. The toner according to claim 1, wherein the toner particle includes a silicone oil; and a content of the silicone oil is at least 1 part by mass and not more than 20 parts by mass with respect to 100 parts by mass of the resin component.

12. The toner according to claim 1, wherein the olefin resin includes an ethylene-vinyl acetate copolymer;

the olefin copolymer including a hydroxyl group includes an ethylene-Poval copolymer; and an amount of the ethylene-vinyl acetate copolymer included in the resin component is more than 50 mass % with respect to the total mass of the resin component.

13. A method for producing a toner comprising a toner particle including a resin component, the resin component including an olefin resin and an olefin copolymer including a hydroxyl group, the method comprising a preparation step of preparing a resin fine particle dispersion in which resin fine particles for producing the resin component are dispersed in an aqueous medium, wherein the olefin resin has a monomer unit Y1 represented by a following formula (1), the olefin copolymer including a hydroxyl group has a monomer unit Z1 represented by a following formula (2) and a monomer unit Z2 represented by a following formula (3), a hydroxyl value of the olefin resin is not more than 10 mg KOH/g, a hydroxyl value of the olefin copolymer including a hydroxyl group is at least 20 mg KOH/g and not more than 250 mg KOH/g, and a content of the olefin resin in the resin component is more than 50 mass % with respect to a total mass of the resin component:

(1)

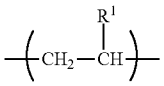

(2)

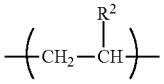

(3)

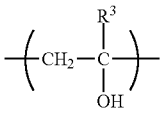

(where $R^1$ represents H or $CH_3$, $R^2$ represents H or $CH_3$, and $R^3$ represents H or $CH_3$).

14. The method for producing a toner according to claim 13, further comprising, after the preparation step of preparing the resin fine particle dispersion:

a aggregation step of aggregating the resin fine particles to form aggregated particles; and a fusing step of heating and fusing the aggregated particles.

15. A toner comprising a toner particle including a resin component, wherein the resin component includes an olefin resin and an olefin copolymer including a hydroxyl group, the olefin resin has a monomer unit Y1 represented by a following formula (1) and at least one monomer unit Y2 selected from the group consisting of a monomer unit represented by a following formula (4) and a monomer unit represented by a following formula (5), the olefin copolymer including a hydroxyl group has a monomer unit Z1 represented by a following formula (2) and a monomer unit Z2 represented by a following formula (3), a hydroxyl value of the olefin resin is not more than 10 mg KOH/g, a content of the monomer unit Y2 is at least 3 mass % and not more than 35 mass % with respect to a total mass of the olefin resin, a hydroxyl value of the olefin copolymer including a hydroxyl group is at least 20 mg KOH/g and not more than 250 mg KOH/g, and a content of the olefin resin in the resin component is more than 50 mass % with respect to a total mass of the resin component:

(1)

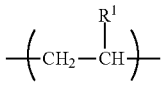

(2)

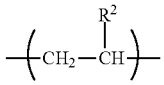

(3)

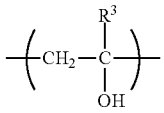

(4)

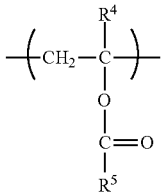

(5)

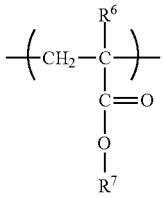

where $R^1$ represents H or $CH_3$, $R^2$ represents H or $CH_3$, $R^3$ represents H or $CH_3$, $R^4$ represents H or $CH_3$, $R^5$ represents $CH_3$ or $CH_2CH_3$, $R^6$ represents H or $CH_3$, and $R^7$ represents $CH_3$ or $CH_2CH_3$.

* * * * *